US010391770B2

(12) United States Patent
Hayashi

(10) Patent No.: US 10,391,770 B2
(45) Date of Patent: Aug. 27, 2019

(54) LIQUID DISCHARGE HEAD, LIQUID DISCHARGE UNIT, AND DEVICE OF DISCHARGING LIQUID

(71) Applicant: Keisuke Hayashi, Kanagawa (JP)

(72) Inventor: Keisuke Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/058,190

(22) Filed: Aug. 8, 2018

(65) Prior Publication Data

US 2018/0345666 A1 Dec. 6, 2018

Related U.S. Application Data

(63) Continuation of application No. PCT/UP2017/004272, filed on Feb. 6, 2017.

(30) Foreign Application Priority Data

Mar. 3, 2016 (JP) ..... 2016-041344

(51) Int. Cl.
*B41J 2/14* (2006.01)
*B41J 2/16* (2006.01)

(52) U.S. Cl.
CPC ..... *B41J 2/1433* (2013.01); *B41J 2/14* (2013.01); *B41J 2/14233* (2013.01); *B41J 2/16* (2013.01)

(58) Field of Classification Search
None
See application file for complete search history.

(56) References Cited

U.S. PATENT DOCUMENTS 5,896,150 A * 4/1999 Kobayashi ..... B41J 2/1612 347/54
6,079,810 A 6/2000 Davis
6,497,474 B2 12/2002 Irinoda et al.
8,425,026 B2 4/2013 Machida et al.
8,646,180 B2 2/2014 Akiyama et al.
(Continued)

FOREIGN PATENT DOCUMENTS

EP 1055518 11/2000
EP 1493579 1/2005
(Continued)

OTHER PUBLICATIONS

International Search Report dated Mar. 28, 2017 in PCT Application No. PCT/JP2017/004272 filed on Feb. 6, 2017.
(Continued)

*Primary Examiner* — Matthew Luu
*Assistant Examiner* — Tracey M McMillion
(74) *Attorney, Agent, or Firm* — IPUSA, PLLC

(57) ABSTRACT

A liquid discharge head includes a flow path substrate including an individual liquid chamber communicating with a nozzle of discharging liquid; and a holding substrate joined to the flow path substrate by an adhesive bond and has an opening communicating with the individual liquid chamber, wherein the opening of the holding substrate has a wall surface crossing relative to a joining surface between the flow path substrate and the holding substrate, wherein an uneven portion is provided on the wall surface of the opening of the holding substrate, and wherein a part of the adhesive bond adheres to the uneven portion on the wall surface.

12 Claims, 14 Drawing Sheets

(56) References Cited

U.S. PATENT DOCUMENTS

| | | | |
|---|---|---|---|
| 8,684,493 | B2 | 4/2014 | Tajima et al. |
| 8,690,297 | B2 | 4/2014 | Ueda et al. |
| 8,727,505 | B2 | 5/2014 | Mizukami et al. |
| 8,727,509 | B2 | 5/2014 | Shimofuku et al. |
| 9,085,145 | B2 | 7/2015 | Shimofuku et al. |
| 9,196,821 | B2 | 11/2015 | Aoyama et al. |
| 9,463,623 | B2 | 10/2016 | Takagi et al. |
| 9,512,521 | B2 | 12/2016 | Watanabe et al. |
| 9,533,502 | B2 | 1/2017 | Machida et al. |
| 9,537,085 | B2 | 1/2017 | Shimofuku et al. |
| 9,583,270 | B2 | 2/2017 | Akiyama et al. |
| 9,595,660 | B2 | 3/2017 | Akiyama et al. |
| 9,634,230 | B2 | 4/2017 | Shimofuku et al. |
| 2008/0278541 | A1 | 11/2008 | Owaki et al. |
| 2014/0307034 | A1* | 10/2014 | Kojima ..... B41J 2/14201 347/71 |
| 2014/0340854 | A1 | 11/2014 | Akiyama et al. |
| 2015/0070444 | A1 | 3/2015 | Ishimori et al. |
| 2016/0221033 | A1 | 8/2016 | Akiyama et al. |

FOREIGN PATENT DOCUMENTS

| | | |
|---|---|---|
| JP | H07-096605 | 4/1995 |
| JP | 2002-347247 | 12/2002 |
| JP | 2003-112427 | 4/2003 |
| JP | 2006-192584 | 7/2006 |
| JP | 2007-203483 | 8/2007 |
| JP | 2008-279651 | 11/2008 |
| JP | 2013-159751 | 8/2013 |
| JP | 2014-124887 | 7/2014 |
| JP | 2014-198460 | 10/2014 |

OTHER PUBLICATIONS

Extended European Search Report for 17759556.8 dated Feb. 11, 2019.

* cited by examiner

LIQUID DISCHARGE HEAD, LIQUID DISCHARGE UNIT, AND DEVICE OF DISCHARGING LIQUID

CROSS-REFERENCE TO RELATED APPLICATIONS

This application is a continuation application filed under 35 U.S.C. 111(a) claiming the benefit under 35 U.S.C. 120 and 365(c) of a PCT International Application No. PCT/JP2017/004272 filed on Feb. 6, 2017, which is based upon and claims the benefit of priority of the prior Japanese Patent Application No. 2016-041344 filed on Mar. 3, 2016, the entire contents of which are incorporated herein by reference.

BACKGROUND OF THE INVENTION

1. Field of the Invention

The present invention relates to a liquid discharge head, a liquid discharge unit, and a device of discharging liquid.

2. Description of the Related Art

An example of a liquid discharge head is formed to join a holding substrate to a flow path substrate which forms an individual liquid chamber communicating with a nozzle using an adhesive bond, and includes the holding substrate having an opening as a flow path communicating with common liquid chamber and the individual liquid chamber on a side of the flow path substrate.

[Patent Document 1] Japanese Unexamined Patent Application Publication No. 2014-124887

[Patent Document 2] Japanese Unexamined Patent Application Publication No. 2014-198460

SUMMARY OF THE INVENTION

It is a general object of at least one embodiment of the present invention to provide a liquid discharge head that substantially obviates one or more problems caused by the limitations and disadvantages of the background art.

When two members are joined by an adhesive bond, high adhesive strength is required.

The present invention is provided in consideration of the above problem. The objects of the present invention are to improve the adhesive strength.

Means for Solving Problems

In order to solve the above object, a liquid discharge head of the present invention includes a first member; and a second member joined to the first member by an adhesive bond, wherein the second member has a wall surface crossing relative to a joining surface between the second member and the first member, wherein an uneven portion is provided on the wall surface of the second member, and wherein a part of the adhesive bond adheres to the uneven portion on the wall surface.

DETAILED DESCRIPTION OF THE PREFERRED EMBODIMENTS

A description is given below, with reference to the FIG. 1 through FIG. 20 of embodiments of the present invention. Where the same reference symbols are attached to the same parts, repeated description of the parts is omitted.

Figure 1:
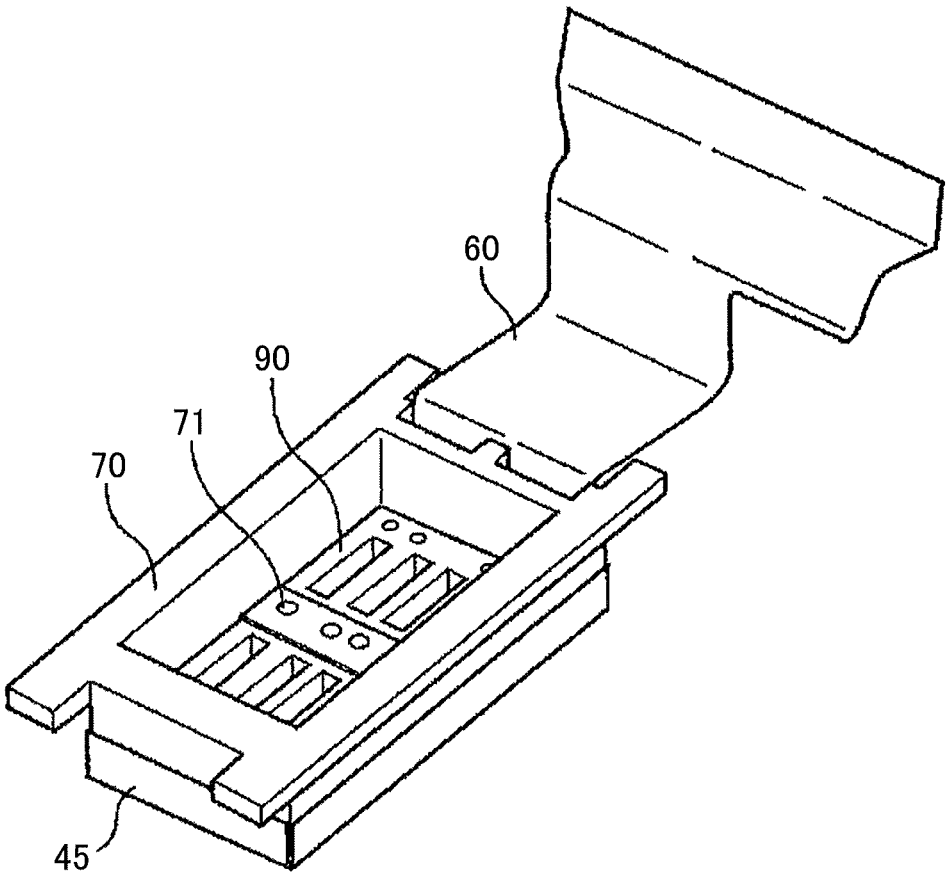
FIG. 1 is a perspective view of an example of the liquid discharge head related to the present invention foe explanation.
Figure 2:
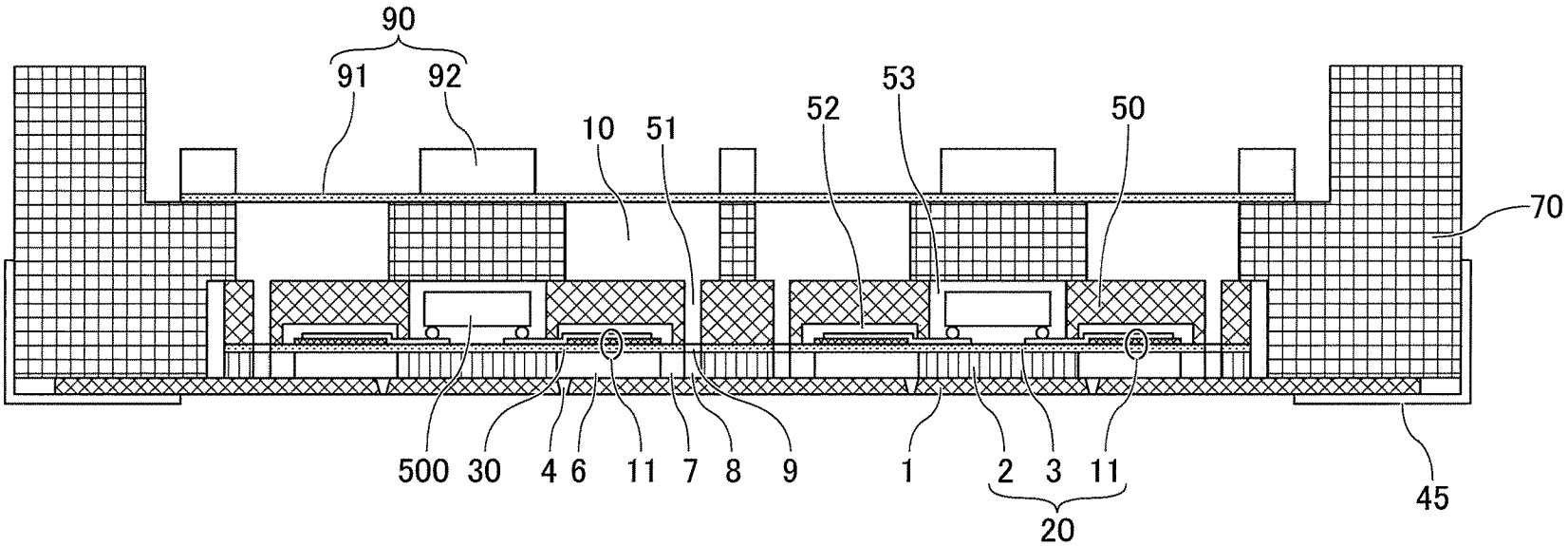
FIG. 2 is a cross-sectional view of an important portion of the liquid discharge head taken along a direction orthogonal to a nozzle arrangement direction for explanation.
Figure 3:
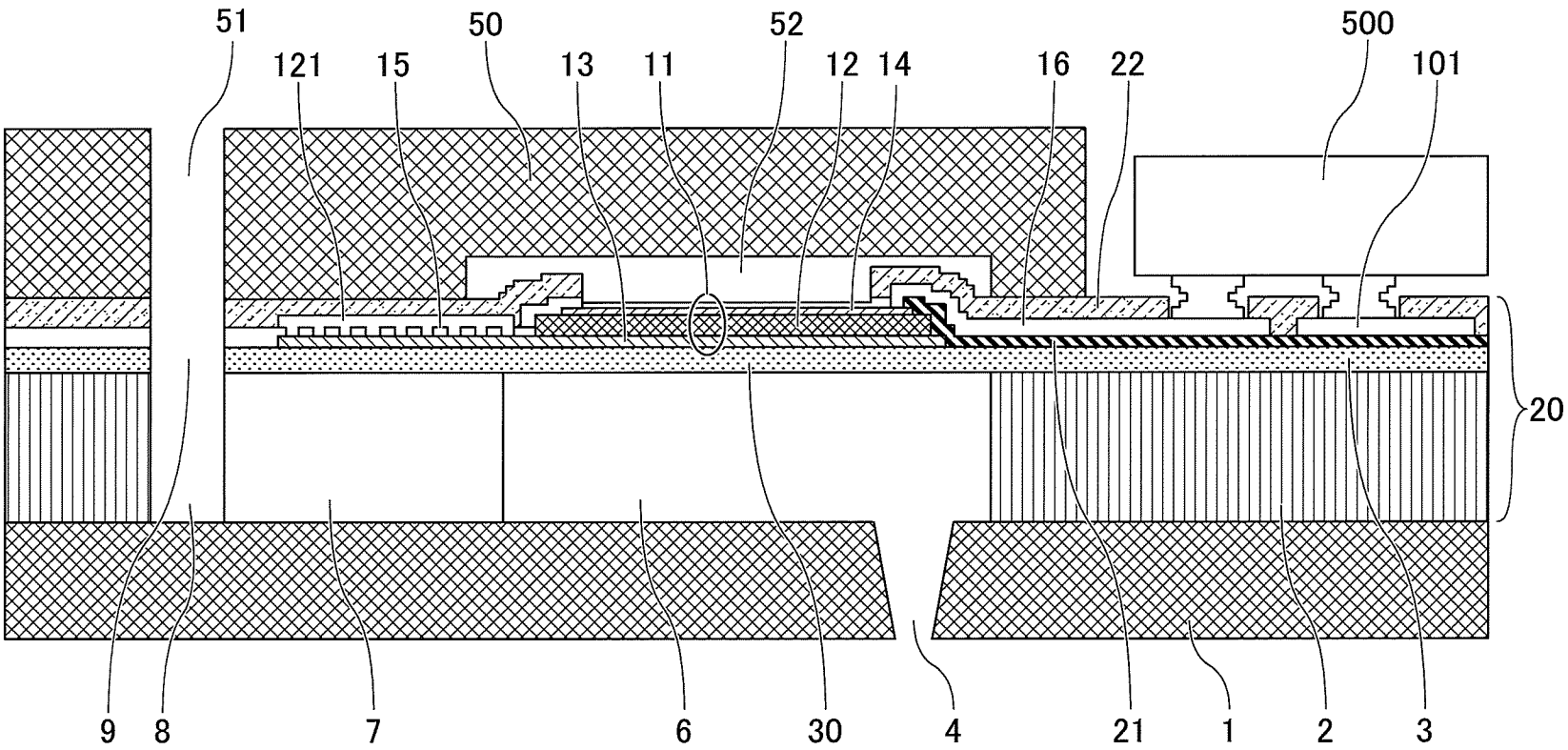
FIG. 3 is an enlarged view of the cross-sectional view of the important portion of the liquid discharge head illustrated in FIG. 2 for explanation.
Figure 4:
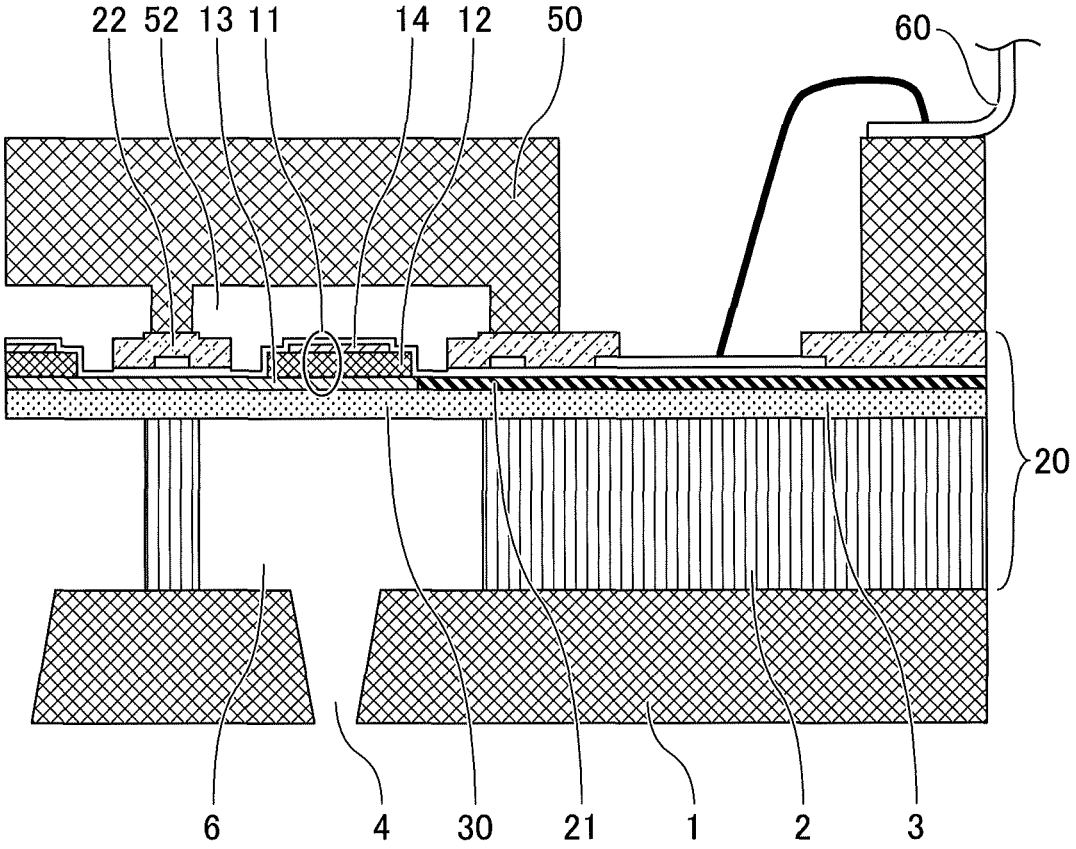
FIG. 4 is a cross-sectional view of an important portion of the liquid discharge head taken along a nozzle arrangement direction for explanation.

Reference symbols typically designate as follows:

1: nozzle plate
2: flow path plate
3: vibration plate
4: nozzle
6: individual liquid chamber
10: common liquid chamber
11: piezoelectric element
20: flow path substrate (first member)
50: holding substrate (second member)
51: opening
55: wall surface
56: uneven portion
70: common liquid chamber member
80: adhesive bond
403: carriage
404: liquid discharge head
440: liquid discharge unit Referring to FIGS. 1 to 4, an example of a liquid discharge head according to the present invention is described. FIG. 1 is a perspective view of a disassembled liquid discharge head for explanation. FIG. 2 is a cross-sectional view taken along a direction orthogonal to a nozzle arrangement direction of the nozzle arrangement direction for explanation. FIG. 3 is an enlarged cross-sectional view of an important portion of FIG. 2 for explanation. FIG. 4 is a cross-sectional view of an important portion of the liquid discharge head taken along the nozzle arrangement direction for explanation.

This liquid discharge head includes a nozzle plate 1, a flow path plate 2, a vibration plate 3, a piezoelectric element 11 as a pressure generating element, a holding substrate 50, a wiring member 60, and a common liquid chamber member 70 also as a frame member.

Here, a part including the flow path plate 2, the vibration plate 3, and the piezoelectric element 11 is called a flow path substrate (a flow path member) 20. However, this does not mean that the flow path substrate 20 is formed as an independent member, and thereafter the flow path substrate 20 is joined to the nozzle plate 1 and the holding substrate 50.

Multiple nozzles 4 for discharging liquid are formed in a nozzle plate 1. Here, this structure includes four nozzle arrays, in which the nozzles 4 are arranged.

The flow path plate 2, the nozzle plate 1, and the vibration plate 3 form the an individual liquid chamber 6 to which the nozzle communicates, a fluid resistance part 7 communicating with the individual liquid chamber 6, and a liquid introducing unit 8 communicating with the fluid resistance part 7.

This liquid introducing unit 8 communicates with the common liquid chamber 10 made of the common liquid chamber member 70 through an opening 9 of the vibration plate 3 and an opening 51 as a flow path of the holding substrate 50.

The vibration plate 3 forms a transformable oscillation region 30 as a part of a wall surface of the individual liquid chamber 6. On a surface opposite to the individual liquid chamber 6 of the oscillation region 30 of the vibration plate 3, a piezoelectric element 11 is integrally formed with the oscillation region 30. A piezoelectric actuator is structured by the oscillation region 30 and the piezoelectric element 11.

The piezoelectric element 11 is structured by sequentially forming a lower electrode 13, a piezoelectric layer (a piezoelectric body) 11, and an upper electrode 14. An insulating film 21 is formed on the piezoelectric element 11.

A lower electrode 13 being the common electrode for the multiple piezoelectric elements 11 is connected to a common electrode power wiring pattern 121 through the common wiring 15. As illustrated in FIG. 4, the lower electrode 13 bridges the entire piezoelectric element 11 in a nozzle arrangement direction.

An upper electrode 14 being an individual electrode of the piezoelectric element 11 is coupled with a drive IC (hereinafter, referred to as a "driver IC") 500 being a driving circuit unit through an individual wiring 16.

The driver IC 500 is installed in the flow path substrate 20 so as to cover a region of line intervals of lines of piezoelectric elements by a manufacturing method such as flip-chip bonding.

The driver IC 500 installed in the flow path substrate 20 is coupled to the individual electrode power wiring pattern to which a drive waveform (a drive signal) is supplied.

A tip end of the wiring member 60 is fixed to a holding substrate 50 using adhesive bond or the like. The tip end of the wiring member 60 is electrically coupled with the driver IC 500 through a wiring electrode on the flow path substrate 20 using wire bonding. The other tip end of the wiring member 60 is coupled to a control unit on a main body side of the apparatus.

On the flow path substrate 20, the holding substrate 50 formed with an opening 51 being a flow path between the common liquid chamber 10 and the individual liquid chamber 6, a recess 52 accommodating the piezoelectric element 11, an opening 53 for accommodating the driver IC 500, and so on are provided.

This holding substrate 50 is joined on the side of the vibration plate 3 of the flow path substrate 20 using adhesive bond.

The common liquid chamber member 70 forms the common liquid chamber 10 for supplying liquid to each individual liquid chamber 6. The common liquid chambers 10 respectively provided four nozzle arrays. The common liquid chambers 10 correspond to the four nozzle arrays. Liquid for a desired color is supplied to the common liquid chamber 10 through a liquid supplying port 71 (FIG. 1) coupled to the outside.

The damper member 90 is joined to the common liquid chamber member 70. The damper member 90 includes a damper forming a part of a wall surface of the common liquid chamber 10 and a damper plate 92 reinforcing the damper 91.

The common liquid chamber member 70 is joined with an outer periphery of the nozzle plate 1. The common liquid chamber member 70 accommodates the flow path substrate 20 including the piezoelectric element 11 and the holding substrate 50 so as to form a frame of the head.

A cover member 45 is provided to cover the periphery of the nozzle plate 1 and a part of an outer peripheral surface of the common liquid chamber member 70 as the frame member.

In this liquid discharge head, by applying a voltage between the upper electrode 14 and the lower electrode 13 of the piezoelectric element 11 from the driver IC 500, the piezoelectric layer 12 extends in an electrode laminating direction, namely, an electric field direction and contract in a direction parallel to the oscillation region 30.

At this time, since the side of the lower electrode 13 is bound in the oscillation region 30, tensile stress is generated on a side of the lower electrode 13 of the oscillation region 30, and the oscillation region 30 undergoes flexure individual liquid chamber 6 to pressurize the liquid inside the individual liquid chamber 6. Thus, the liquid is discharged from the nozzle.

Referring to FIGS. 3 and 4, the protection film 22 (a passivation film) is provided on the individual wiring 16 so as to protect the wiring material from damages caused by moisture, contamination, or the like. The material of the protection film 22 is, for example, silicon nitride SiN.

Figure 5:
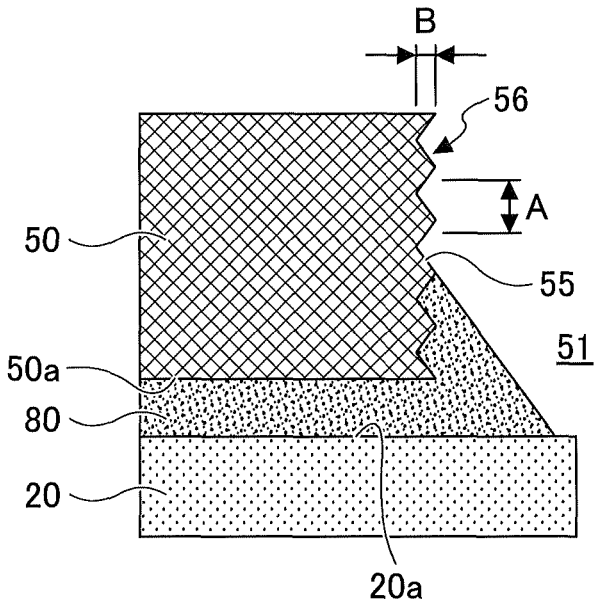
FIG. 5 is a cross-sectional view of a part of an opening of a flow path substrate and a holding substrate according to a first embodiment for explanation.

Next, first embodiment of the present invention is described with reference to FIG. 5. FIG. 5 is a cross-sectional view of a part of the opening of the flow path substrate and the holding substrate according to the first embodiment for explanation.

Within the first embodiment, the first member is the flow path substrate 20, the second member is the holding substrate 50, and a joining surface 50*a* of the holding substrate 50 is joined to the joining surface 20*a* of the flow path substrate 20.

A wall surface 55 of an opening 51 of the holding substrate 50 is a wall surface crossing the joining surface 50*a* of the holding substrate 50 joined to the joining surface 20*a* of the flow path substrate 20.

A wall surface 55 of the opening 51 in the holding substrate 50 as the second member is provided with an uneven portion 56 formed to be uneven. Here, the uneven portion 56 has a cross-sectional shape of triangular unevenness. Referring to FIG. 5, the width A and the depth B of one uneven portion 56 are illustrated. It is preferable that both the width A and the depth are in a range of 0.1 to 1 μm.

A part of adhesive bond 80 for joining the joining surface 20*a* of the flow path substrate 20 to joining surface 50*a* of the holding substrate adheres to the uneven portion 56 on at least a part of the wall surface 55 while filling the uneven portion 56 with the adhesive bond 80.

Resultantly, an adhesive area of the adhesive bond 80, in which the flow path substrate 20 is joined to the holding substrate 50, is widened to improve the adhesive strength.

Figure 6:
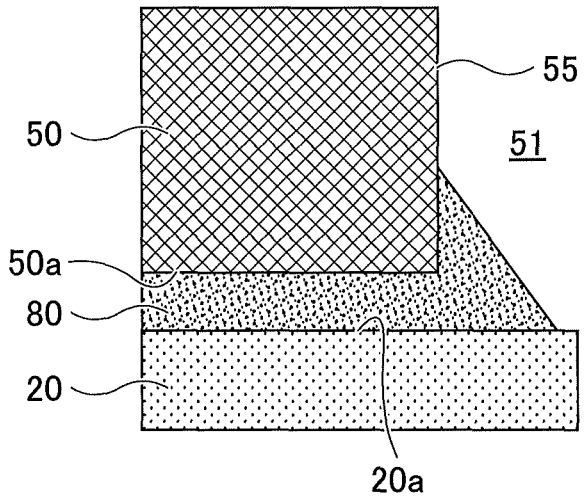
FIG. 6 is a cross-sectional view of a part of an opening of a flow path substrate and a holding substrate according to a comparative example for explanation.

Because the uneven portion 56 is provided on the wall surface 55 of the opening 51 of the holding substrate 50, the adhesive area is widened so as to improve the adhesive strength in comparison with a case where the wall surface 55 is flat as in a comparative example illustrated in FIG. 6.

Figure 7:
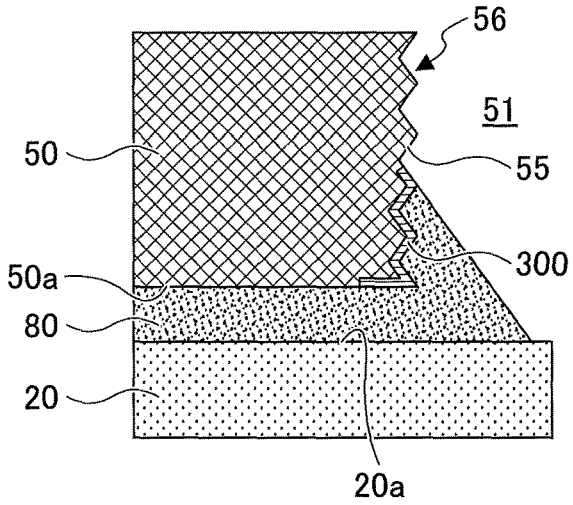
FIG. 7 is a cross-sectional view of the part of the opening of the flow path substrate and the holding substrate according to the first embodiment for explaining function.

Because the uneven portion 56 is provided on the wall surface 55 of the opening 51 of the holding substrate 50, as illustrated in FIG. 7, if the liquid 300 intrudes between the wall surface 55 of the opening 51 of the holding substrate 50 and the adhesive bond 80, a distance to the joining surface 50*a* is longer than in the comparative example illustrated in FIG. 6. With this, a time duration while the adhesive strength is effective is kept to be long so that the life duration is prolonged and the reliability is improved.

Figure 8:
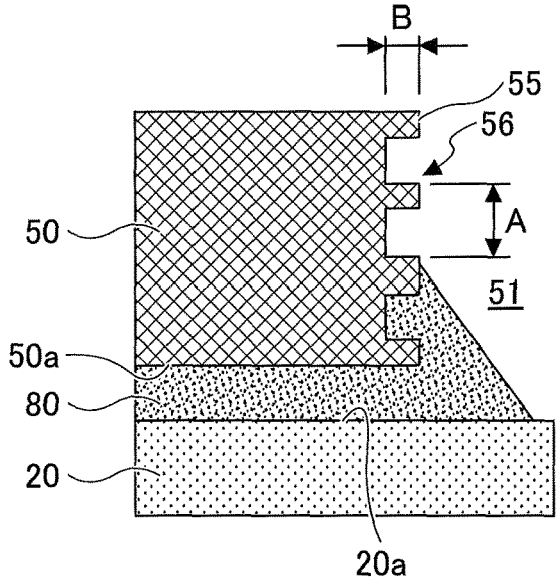
FIG. 8 is a cross-sectional view of the part of the opening of the flow path substrate and the holding substrate according to a second embodiment for explanation.

Next, a second embodiment of the present invention is described with reference to FIG. 8. FIG. 8 is a cross-sectional view of a part of the opening of the flow path substrate and the holding substrate according to the second embodiment for explanation.

Within the second embodiment, the wall surface 55 of the opening 51 in the holding substrate 50 as the second member is provided with the uneven portion 56 having a cross-sectional shape of rectangular unevenness. Referring to FIG. 8, the width A and the depth B of one uneven portion 56 are illustrated. It is preferable that both the width A and the depth are in a range of 0.1 to 1 μm. As such, functions and effects similar to the first embodiment are obtainable.

Figure 9:
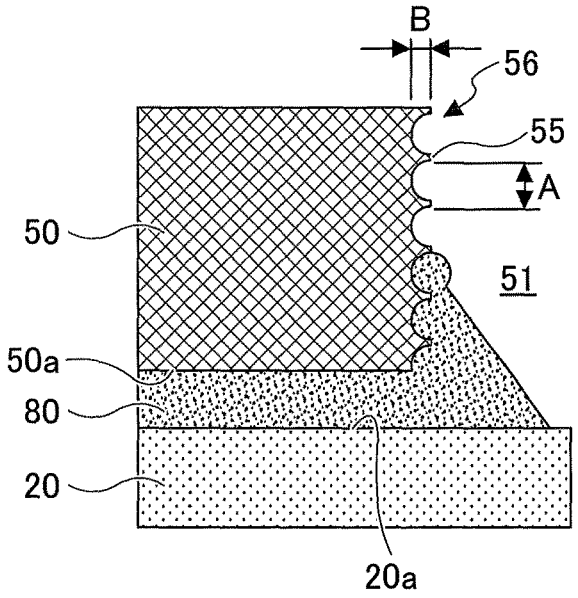
FIG. 9 is a cross-sectional view of the part of the opening of the flow path substrate and the holding substrate according to a third embodiment for explanation.

Next, a third embodiment of the present invention is described with reference to FIG. 9. FIG. 9 is a cross-sectional view of a part of the opening of the flow path substrate and the holding substrate according to the third embodiment for explanation.

Within the third embodiment, the wall surface 55 of the opening 51 in the holding substrate 50 as the second member is provided with the uneven portion 56 having a cross-sectional shape of substantially semi-circular unevenness. Referring to FIG. 9, the width A and the depth B of one uneven portion 56 are illustrated. It is preferable that both the width A and the depth are in a range of 0.1 to 1 μm. As such, functions and effects similar to the first embodiment are obtainable.

Figure 10:
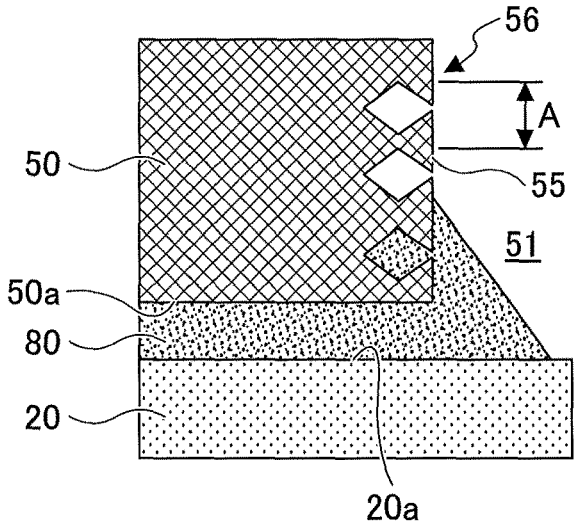
FIG. 10 is a cross-sectional view of the part of the opening of the flow path substrate and the holding substrate according to a fourth embodiment for explanation.

Next, a fourth embodiment of the present invention is described with reference to FIG. 10. FIG. 10 is a cross-sectional view of a part of the opening of the flow path substrate and the holding substrate according to the fourth embodiment for explanation.

Within the fourth embodiment, the wall surface 55 of the opening 51 in the holding substrate 50 as the second member is provided with the uneven portion 56 having a cross-sectional shape of substantially parallelogram unevenness. Referring to FIG. 10, the width A and the depth B of one uneven portion 56 are illustrated. It is preferable that both the width A and the depth are in a range of 0.1 to 1 μm.

With this shape, the adhesive bond 80 fills the inside of parallelograms of unevenness, an anchor effect becomes higher so as to improve the strength more than that expected by the area ratio.

Figure 11:
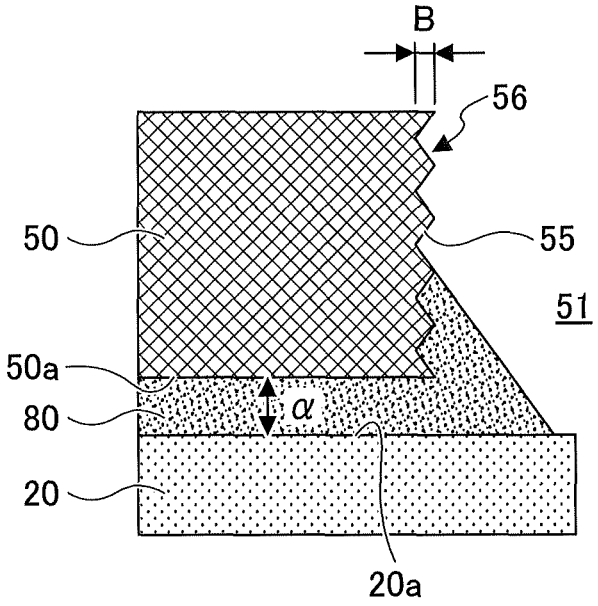
FIG. 11 is a cross-sectional view of the part of the opening of the flow path substrate and the holding substrate for explaining a relation between the size of unevenness in its depth direction and the layer thickness of adhesive bond.

Next, referring to FIG. 11, a relation between the depth of the uneven portion and the thickness of the adhesive bond is described. FIG. 11 is a cross-sectional view of the part of the opening of the flow path substrate and the holding substrate for this explanation.

The depth B of the uneven portion 56 is preferably equal to a thickness (a layer thickness) $\alpha$ of the adhesive bond between the joining surfaces 20*a* and 50*a* of the first member (the flow path substrate 20) and the second member (the holding substrate 50) ($B \leq \alpha$).

With this, the adhesive bond 80 supplied at a time of bonding is certainly supplied to the uneven portion 56 of the wall surface 55 to ensure a margin of adhesive strength relative to a variation in a supplied amount of the adhesive bond 80.

Further, in a case where the opening 51 of the holding substrate 50 is provided for each individual liquid chamber 6, the uneven portions 56 of the wall surfaces 55 of the multiple openings 51 are preferably the same. With this, the variation of the amount supplied to the uneven portion 56 is reduced so as to lower the variation in the adhesive strength.

Figure 12:
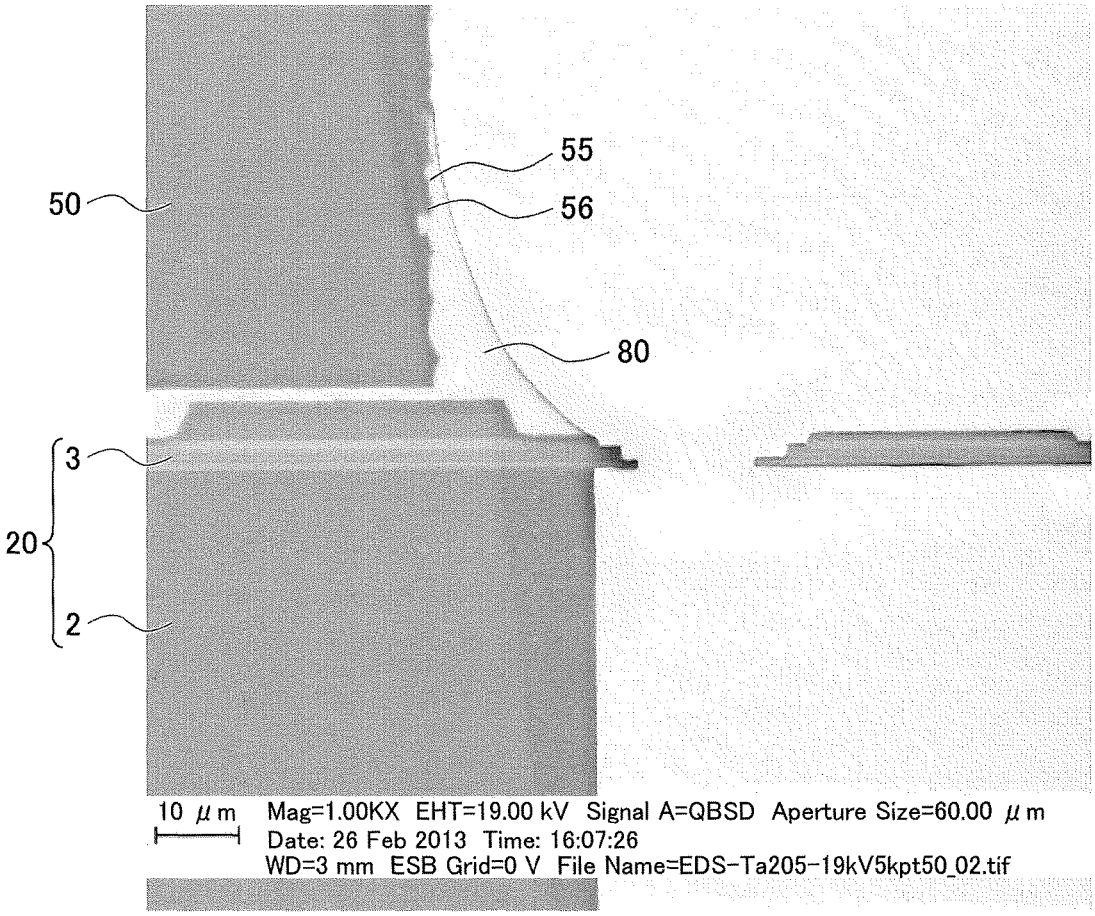
FIG. 12 is an example of SEM photographs of the part of the opening of the flow path substrate and the holding substrate.

FIG. 12 is an example of SEM photographs of the part of the opening of the flow path substrate and the holding substrate. The uneven portion 56 is provided on the wall surfaces 55 of the multiple openings 51 in the holding substrate 50. The adhesive bond 80 enters into the uneven portion 56.

Figure 13:
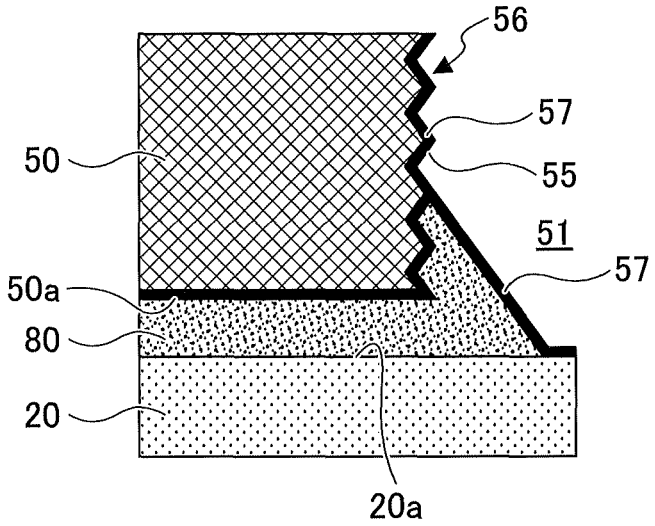
FIG. 13 is a cross-sectional view of the part of the opening of the flow path substrate and the holding substrate according to a fifth embodiment for explanation.

Next, a fifth embodiment of the present invention is described with reference to FIG. 13. FIG. 13 is a cross-sectional view of a part of the opening of the flow path substrate and the holding substrate according to the fifth embodiment for explanation.

Within the fifth embodiment, the wall surface 55 and the joining surface 50*a* of the opening 51 of the holding substrate 50 is covered by a surface treatment film 57 having a liquid resistance. Further, the surface of the adhesive bond 80 flown on a side of the opening 51 and adhered to the uneven portion 56 is covered by the surface treatment film 57.

Accordingly, it is possible to prevent the adhesive bond 80 from being damaged by corrosion and dissolution caused by the liquid. Further, because the surface treatment film 57 covering the surface of the adhesive bond and the surface treatment film 57 covering the wall surface 55 of the opening 51 are the same, compatibility becomes high, the films firmly bond, the interface strength becomes high, and therefore the reliability is improved.

Figure 14:
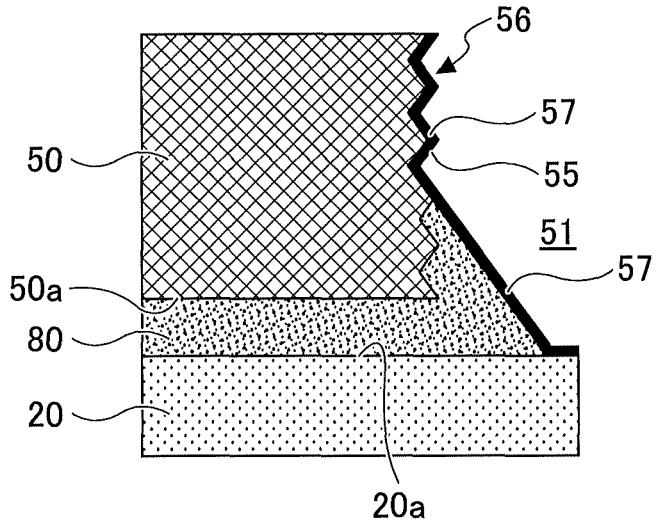
FIG. 14 is a cross-sectional view of the part of the opening of the flow path substrate and the holding substrate according to a sixth embodiment for explanation.

Next, a sixth embodiment of the present invention is described with reference to FIG. 14. FIG. 14 is a cross-sectional view of a part of the opening of the flow path substrate and the holding substrate according to the sixth embodiment for explanation.

Within the sixth embodiment, after the holding substrate 50 is joined to the flow path substrate 20, the surface treatment film 57 is formed. The surface treatment film 57 is not present between the uneven portion 56 and the adhesive bond 80.

With this structure, the adhesive bond 80 can be prevented from the corrosion caused by the liquid.

Figure 15:
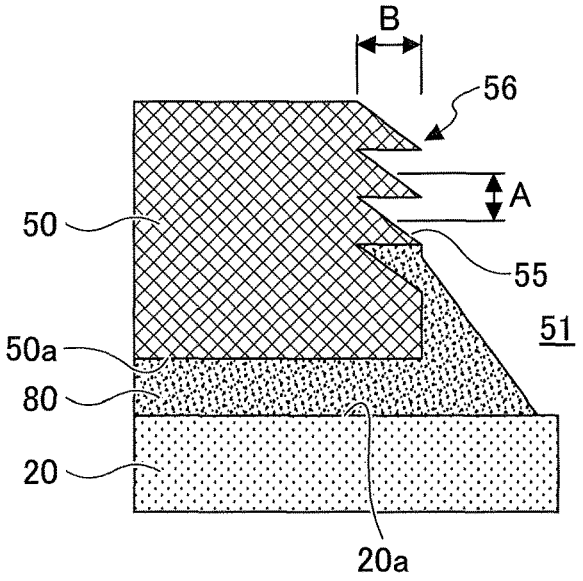
FIG. 15 is a cross-sectional view of the part of the opening of the flow path substrate and the holding substrate according to a seventh embodiment for explanation.

Next, a seventh embodiment of the present invention is described with reference to FIG. 15. FIG. 15 is a cross-sectional view of a part of the opening of the flow path substrate and the holding substrate according to the seventh embodiment for explanation.

Within the seventh embodiment, the wall surface 55 of the opening 51 in the holding substrate 50 as the second member is provided with the uneven portion 56 having a cross-sectional shape of substantially triangular shape.

One side of the cross-sectional shape of the substantially triangular shape is substantially parallel to the joining surface 20*a*. The state of "substantially parallel" may be or may not be completely parallel. The cross-sectional shape of the substantially triangular shape is a continuous and repeated wave form in which triangular shapes are continuously repeated.

Figure 16:
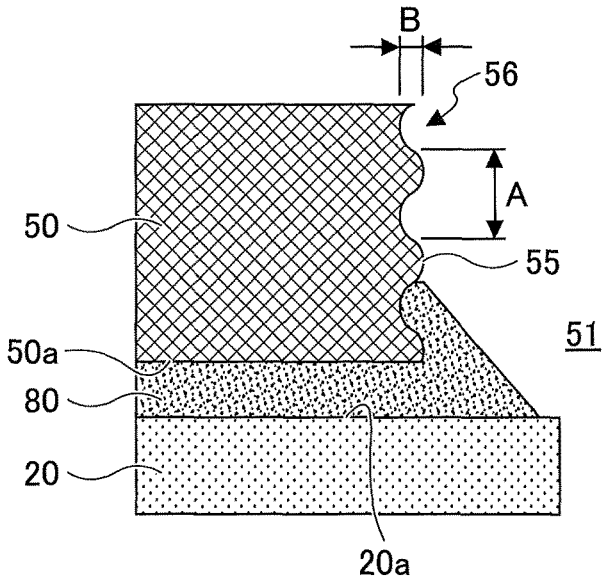
FIG. 16 is a cross-sectional view of the part of the opening of the flow path substrate and the holding substrate according to an eighth embodiment for explanation.

Next, a sixth embodiment of the present invention is described with reference to FIG. 16. FIG. 16 is a cross-sectional view of a part of the opening of the flow path substrate and the holding substrate according to the eighth embodiment for explanation.

Within the eighth embodiment, the wall surface 55 of the opening 51 in the holding substrate 50 as the second member is provided with the uneven portion 56 having a cross-sectional shape of substantially semi-circular shape.

The cross-sectional shape of the substantially semi-circle shape is a continuous and repeated wave form in which semi-circle shapes are continuously repeated.

Next, an example of the above-described surface treatment film is explained.

The surface treatment film 57 is an oxide film containing Si. The oxide film includes a transition metal, such as aluminum, bismuth, antimony, tantalum, niobium, titanium, hafnium, zirconium, zinc, and tungsten, of forming a passive film by binding through Si and oxygen.

Here, the surface treatment film 57 is a composite oxide film of Si, which has a high liquid resistance and is provided to improve contact with the transition metal species having ion radius of 68 or greater (+trivalence or more) and the adhesive bond 80.

Because the above transition metal species may form a stable oxide, a stable state may be maintained inside the solution, high durability against the liquid may be performed.

The oxide film containing Si has good compatibility with an anionic type hardener and a silane coupling agent so as to improve the contact with the adhesive bond 8.

As described, because the surface treatment film is formed on a wall surface of the flow path, the surface treatment film is an oxide film containing Si, and the oxide film includes the transition metal that forms the passive film by binding through Si and oxygen, the contact between the surface treatment film and the adhesive bond is improved and simultaneously the liquid resistance is improved.

Said differently, the contact with the member is high by including $SiO_2$, and the contact with the adhesive bond is high enough to obtain bonding force having high water resistance by using the amine type hardener or the silane coupling agent.

Further, because the stable corrosion-resistant film is formed on the surface of the surface treatment film by forming the passive film, even though the surface treatment film touches the liquid, the surface of the surface treatment film does not dissolve so as to be stabilized for a long time.

Further, because the transition metal has an orbit of a vacant place in the inner orbit such as the d orbit and the f orbit, multiple oxidation numbers may be obtained. Therefore, because the surface treatment film includes transition metal species, the correspondence to the oxidation number of the entire film is enhanced. Accordingly, the tolerance for excess and deficiency of the number of oxygen atoms becomes wider, and a change in dissolubility caused by the excess and deficiency of the number of oxygen atoms in the film may be prevented.

In a case where the transition metal is not included, a defect may occur in the surface treatment film due to the excess or deficiency of the oxygen atoms. Because an energy state of the defect is high, the dissolution is apt to occur. On the contrary thereto, when the transition metal is included, the defect of the surface treatment film is reduced, the stability of the oxide film is enhanced, and the dissolubility to the liquid is lowered.

Among these transition metals, a metal such as a valve metal of forming a passive film may be used to further reduce the dissolubility of the surface treatment film.

The metal forming the passive film is aluminum, bismuth, antimony, tantalum, niobium, titanium, hafnium, zirconium, zinc, and tungsten. In consideration of the correspondence to the oxidation number, tantalum, niobium, titanium, hafnium, zirconium, zinc, and tungsten are preferable.

Because hafnium, tantalum, zirconium, niobium, chrome, and ruthenium form extremely stable oxide film regardless of pH (acidic property or alkaline property) of the liquid to contact, there is an advantage that a stable state may be maintained regardless of the type of the liquid.

Said differently, the surface treatment film preferably contains a group 4 or 5 transition metal that forms the passive film. By introducing the group 4 or 5 transition metal that forms the passive film into the $SiO_2$ film, the film having an electron orbit similar to Si of the group 4 and strong binding between Si and the above metal species through O is obtainable so as to improve filling ability of the film.

In addition to the improvement of filling ability, by causing firm binding of Si—O bond to be present inside the surface treatment film, a corrosion reaction occurring at a time of contacting the liquid may be suppressed. With this, the oxide film having the durability to the liquid is formed, sufficient durability is ensured, and the reliability of the head can be improved.

In this case, the group 4 or 5 transition metal preferably includes at least one type from among Hf, Ta, and Zr.

By introducing at least one type from among Hf, Ta, and Zr into the $SiO_2$ film, the transition metal species is very strongly bound to O to form the passive film. In addition to the improvement of filling ability, by causing the function of the passive film to be present inside the surface treatment film, a corrosion reaction occurring at a time of contacting the liquid having both the acidic and alkaline properties may be drastically suppressed.

With this, the oxide film having the durability against the liquid having acidic or alkaline property may be formed.

Further, it is preferable that the alloy film of the surface treatment film is completely oxidized.

With this, the crystal structure of the surface treatment film is changed to be amorphous, grain boundary of the crystal apt to cause corrosion when exposed to the liquid is scarcely present, and therefore high durability against the liquid is obtainable.

Further, it is preferable that Si is contained in the surface treatment film as many as 17 at %. When Si of at least 17 at % is contained in the surface treatment film, the surface treatment film may be a perfectly transparent film. Preferably, Si of at least 20% is contained.

With this, it is possible to form a film having small variation of the amorphous state, and therefore it is possible to suppress generation of a part locally weak to the liquid due to the partial presence of the crystal. In a case where the content of Si in the film is small, the other metal species condense to be crystal. Thus, the film quality becomes uneven. Such unevenness may cause a battery effect between Si and the other metal species when the liquid comes, and then a corrosion reaction may occur.

Here, it is possible to determine whether the alloy film forming the surface treatment film is completely oxidized by judging whether the film transmits the visible light because the film is amorphous. For example, an ellipsometer of a multi-wavelength type may be used to judge that the oxidation is complete when an attenuation coefficient (k) is at most 0.1, preferably at most 0.03, in a wavelength range of 400 to 800 nm.

Further, it is preferable that the transition metal is contained in the surface treatment film at least 2 at %. With this, the density of the surface treatment film is certainly improved, and the durability to the liquid is improved. More preferably, the transition metal is contained in the surface treatment film at least 3.5 at % and at most 13.5 a. With this, the structure of the surface treatment film has lesser defects and a higher filling rate so that the durability against the liquid tends to be acquired.

As a method of checking the film, the ellipsometer is used to check whether the refractive index is a constant value. For example, regarding the refractive index for a single film, for example, an $SiO_2$ film is 1.4, and a $Ta_2O_5$ film is 2.1. Therefore, the refractive index of the surface treatment film that is completely oxidized is between 1.4 and 2.1. However, in a case where the metal species in the surface treatment film are not completely oxidized, both the transmission factor and the refractive index increase. Therefore, a predetermined film quality id obtainable by controlling both the transmission factor and the refractive index.

In a case where the refractive indexes of the metallic oxide films forming the surface treatment film are different, it is possible to control the ratio in the alloy using the refractive indexes.

With this, a non-destructive high speed measurement in the atmosphere becomes possible. In an actual mass-production process, conditions of the surface treatment may be easily controlled.

Next, an example of forming the uneven portion is described.

In a case where the holding substrate 50 is made of silicon, the uneven portion 56 is effectively formed by an ICP etching method using a Bosch process. Because protection is provided and etching is conducted repeatedly in the depth direction, it is possible to form the unevenness on the wall surface 55 of the opening 51 in accordance with the etching cycle number. Depending on the condition of forming a deposit film and an etching condition change, the size of the unevenness may be changed within a certain range.

Within the above embodiments, the first member is the flow path substrate, and the second member is the holding substrate. However, the invention is not limited thereto and may be applied to a joining member including a member having a wall surface crossing the joining surface. Further, the wall surface is not limited to that of the opening and may be a wall surface of an outer peripheral surface.

Therefore, in the above head structure, the present invention is applicable to, for example, joining between the flow path plate 2 and the nozzle plate 1, joining between the holding substrate 50 and the common liquid chamber member 70, joining between the common liquid chamber member 70 and the damper member, and so on.

Figure 17:
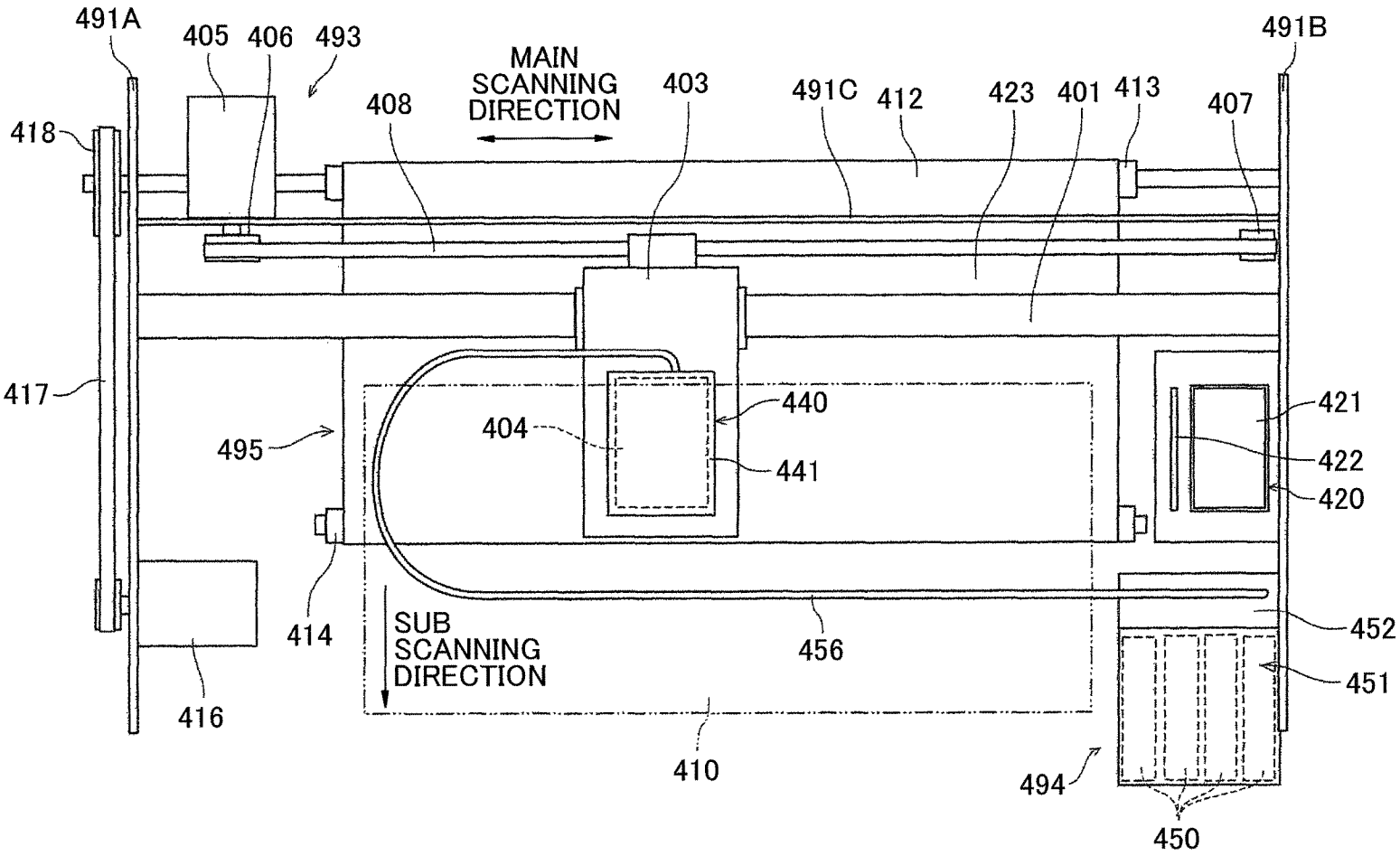
FIG. 17 is a plan view of an important portion of an example of a device of discharging liquid of the embodiment for explanation.
Figure 18:
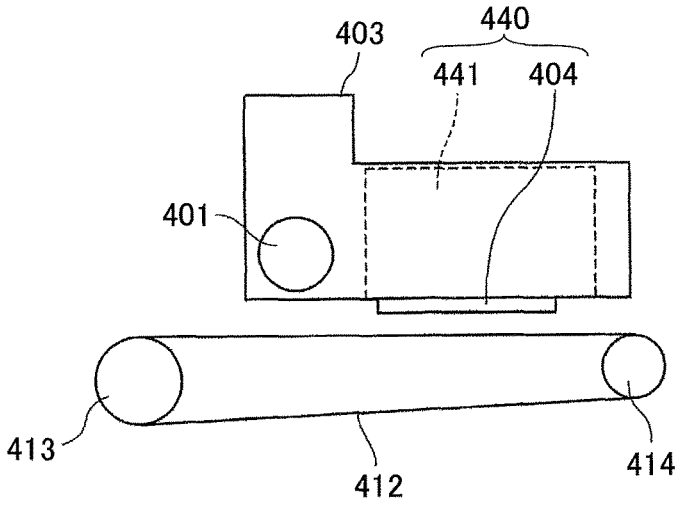
FIG. 18 is a side view of an important portion of the liquid discharge unit for explanation.

Referring to FIGS. 17-18, an example of a device of discharging liquid is described next. FIG. 17 is a plan view of an important portion of this device of discharging liquid, for explanation. FIG. 18 is a side view of the important portion of this device of discharging liquid, for explanation.

This device of discharging liquid is a serial type apparatus, in which a carriage 403 performs reciprocating movement in main scanning directions by a main scanning movement mechanism 493. The main scanning movement mechanism 493 includes a guide member 401, a main scanning motor 405, a timing belt 408, and so on. The guide member 401 bridges right and left side plates 491A and 491B and holds the carriage 403 so as to be movable. The carriage 403 performs the reciprocating movement in the main scanning direction by the main scanning motor 405 through a timing belt 408 provided between a drive pulley 406 and a driven pulley 407.

This carriage 403 includes a liquid discharge unit 440 formed by integrating the liquid discharge head 404 of the present invention and a head tank 441. The liquid discharge head 404 of the liquid discharge unit 440 discharges liquids respectively having colors of, for example, yellow (Y), cyan (C), magenta (M), and black (K). In the liquid discharge head 404, a nozzle array including multiple nozzles is arranged in a sub scanning direction orthogonal to the main scanning direction. A discharge direction is set to be downward.

The liquid stored in a liquid cartridge 450 is supplied to the head tank 441 by a supplying mechanism 494 for supplying the liquid stored outside the liquid discharge head 404 to the liquid discharge head 404.

The supplying mechanism 494 is structured by a cartridge holder 451 as a filling unit, to which the liquid cartridge 450 is attached, a tube 456, a liquid sending unit 452 including the liquid sending pump, and so on. The liquid cartridge 450 is attachable to and detachable from the cartridge holder 451. The liquid is sent from the liquid cartridge 450 through the tube 456 to the head tank 441 by the liquid sending unit 452.

This device includes a carrying mechanism 495 for carrying a paper 410. The carrying mechanism 495 includes a carrying belt 412 as a carrying means and a sub scanning motor 416 for driving the carrying belt 412.

The carrying belt 412 adsorbs the paper 410 and carries at a position opposite to the liquid discharge head 404. The carrying belt 412 is an endless belt and bridges between a carrying roller 413 and a tension roller 414. The adsorption may be attained by electrostatic adsorption, air suction, and so on.

The carrying belt 412 is rotated to move in the sub scanning direction when the sub scanning motor 416 drives to rotate the carrying roller 413 through a timing belt 417 and a timing pulley 418.

A maintenance and restoration mechanism 420 for performing maintenance and restoration of the liquid discharge head 404 is provided at a side of the carrying belt 412 on one side along the main scanning direction of the carriage 403.

The maintenance and restoration mechanism 420 is formed by a capping member 421 for capping a nozzle face (a face where the nozzle is formed) of the liquid discharge head 404, a wiper member 422 for wiping the nozzle face, and so on, for example.

The main scanning movement mechanism 493, the supplying mechanism 494, the maintenance and restoration mechanism 420, and the carrying mechanism 495 are attached to a casing including side plates 491A and 491B and a back plate 491C.

In thus structured device, the paper 410 is supplied onto the carrying belt 412 and adsorbed, and the paper 410 is carried in the sub scanning direction when the carrying belt 412 rotates to move.

Therefore, by driving the liquid discharge head 404 in response to an image signal while the carriage 403 is being moved in the main scanning direction, the liquid is discharged onto the stopping paper 410 to form an image.

As such, the liquid discharge head is provided in this device of the present invention, a high quality image may be stably formed.

Figure 19:
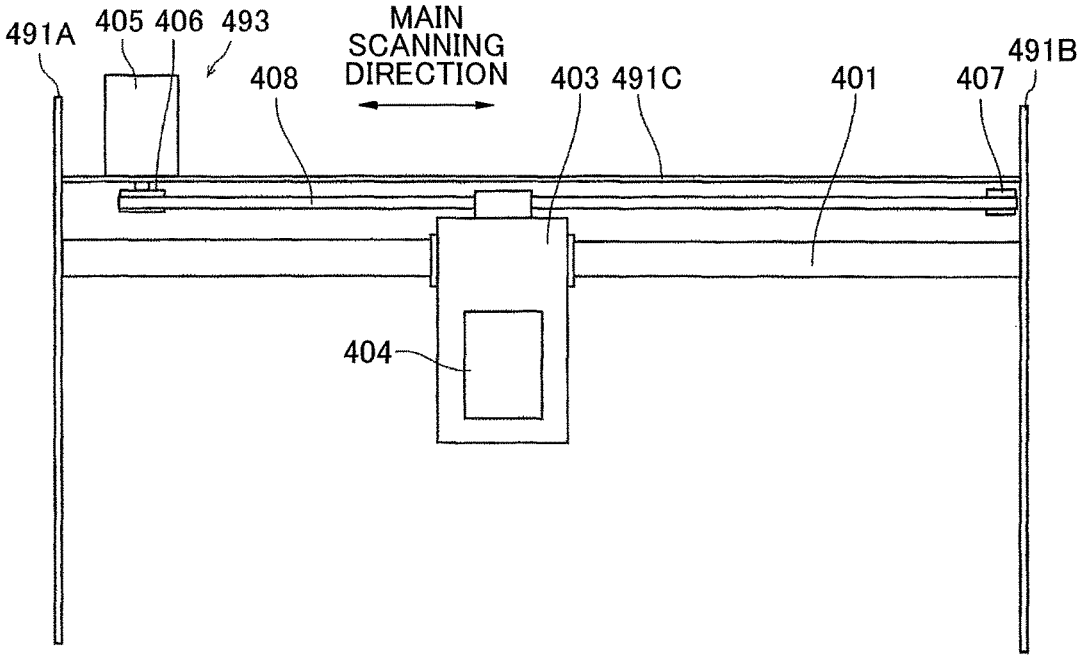
FIG. 19 is a plan view of an important portion of another example of a liquid discharge unit of the embodiment for explanation.

Referring to FIG. 19, another example of a liquid discharge unit according to the present invention is described next. FIG. 19 is a plan view of an important portion of the liquid discharge unit for explanation.

This liquid discharge unit is structured to have a casing part formed by the side plates 491A and 491B and the back plate 491C, the main scanning movement mechanism 493, the carriage 403, and the liquid discharge head 404, from among members forming the device of discharging liquid.

In the liquid discharge unit, at least one of the maintenance and restoration mechanism 420 and the supplying mechanism 494 may be further attached onto, for example, the side plate 491B to form another liquid discharge unit.

Figure 20:
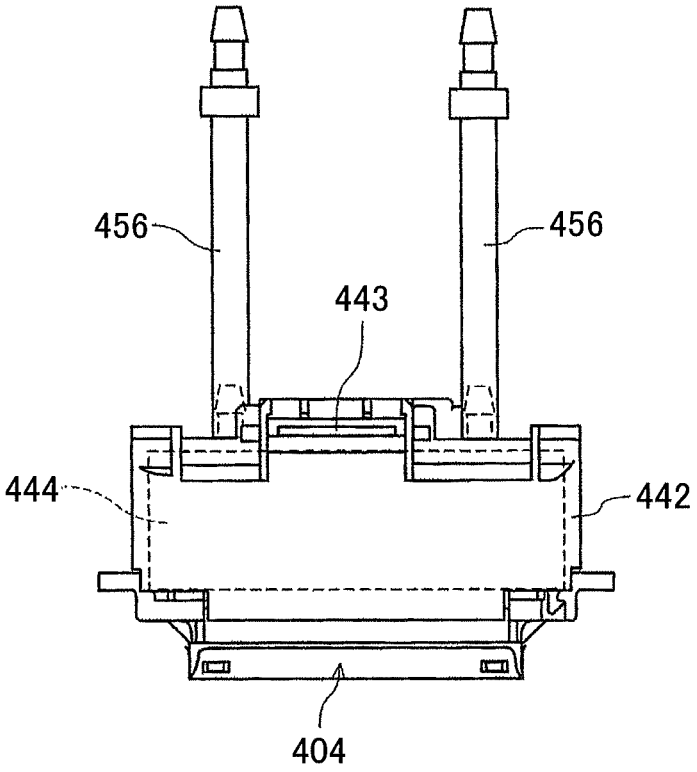
FIG. 20 is a front view of another important portion of another example of a liquid discharge unit of the embodiment for explanation.

Referring to FIG. 20, another example of the liquid discharge unit according to the present invention is described next. FIG. 20 is a plan view of an important portion of the liquid discharge unit for explanation.

This liquid discharge unit includes the liquid discharge head 404 to which the flow path part 444 is attached, and the tube 456 coupled to the flow path part 444.

The flow path part 444 is disposed inside the cover 442. In place of the flow path part 444, the head tank 441 may be included. Further, a connecter 443 for electrically coupling to the liquid discharge head 404 is provided on an upper part of the flow path part 444.

The liquid discharged in the present invention is not especially limited, and is sufficient to have the viscosity and surface tension enabling discharging from the head. It is preferable that the viscosity is at most 30 mPa·s at ordinary temperatures and pressures or heating and cooling. More specifically, the liquid is solution, suspension liquid, or emulsion containing solvent such as water and organic solvent, colorant such as dye and pigment, polymerizable compound, resin, function providing material such as surface active agent, biomaterial such as DNA, amino acid, protein, and calcium, edible material such as natural pigment. This liquid may be used as an inkjet ink, a treatment liquid, a constitutional element for forming an electronic element or a light emitting element, a liquid for forming an electronic circuit resist pattern, a 3D modeling material liquid, and so on.

An energy generation source for discharging the liquid is a piezoelectric actuator (a laminated piezoelectric element and a thin film type piezoelectric element), a thermal actuator using electric heat conversion element such as a heating resistor, a static actuator formed by a vibration plate and opposite electrodes, and so on.

The "liquid discharge unit" is formed by unifying the functional parts and the mechanism into the liquid discharge head, and includes an aggregate of the parts related to the discharge of the liquid. For example, the "liquid discharge unit" includes a combination of the liquid discharge head with at least one of, for example, the head tank, the carriage, the supplying mechanism, the maintenance and restoration mechanism, and the main scanning movement mechanism.

Here, the unification means that the liquid discharge head is related to the functional part or the mechanism using mutual fixing such as fastening, bonding, and engaging, or using holding so that one is movable with respect to the other. Further, the liquid discharge head, the functional part, and the mechanism may be mutually attachably and detachably structured.

For example, the liquid discharge unit is unification of the liquid discharge head and the head tank. Further, there is the unification of the liquid discharge head and the head tank by mutual connection using a tube. Here, a unit including a filter may be added between the head tank and the liquid discharge head in these liquid discharge units.

For example, the liquid discharge unit is unification of the liquid discharge head and the carriage.

Further, the liquid discharge unit is unification of the liquid discharge head and a scanning moving mechanism by making the liquid discharge head movably hold by a guide member forming a part of the scanning moving mechanism. Further, there is unification of the liquid discharge head, the carriage, and the main scanning movement mechanism.

Further, the carriage is provided with the liquid discharge head, to which a cap member as a part of the maintenance and restoration mechanism is fixed, and the liquid discharge unit is the unification of the liquid discharge head, the carriage, and the maintenance and restoration mechanism.

Further, a tube is connected to the head tank or the liquid discharge head provided with a flowing path part, and the liquid discharge unit is the unification of the liquid discharge head and the supplying mechanism. Through this tube, the liquid in the liquid storing source is supplied to the liquid discharge head.

The main scanning movement mechanism includes the guide member itself. The supplying mechanism includes the tube itself and a charging part itself. The "device of discharging liquid" includes a device provided with the liquid discharge head or the liquid discharge unit to drive the liquid discharge head so as to cause the liquid to be discharged. The device of discharging liquid includes not only a device enabled to discharge the liquid toward an object to which the liquid can be adhered but also a device of discharging the liquid into an object in a gas phase or a liquid phase.

This "device of discharging liquid" includes a means of feeding, carrying, and ejecting the object to which the liquid can be adhered, a pre-processing device, a post-processing device, and so on.

For example, the "device of discharging liquid" is an image forming apparatus of forming an image on paper by injecting an ink and a solid modeling apparatus (a 3D modeling apparatus) of discharging molding liquid toward a powder layer which is formed in layers so as to make a solid model (a 3D model).

The "device of discharging liquid" is not limited to obtain what visualizes a significant image such as a letter and a pictorial figure using the discharged liquid. For example, the "device of discharging liquid" may form a pattern having no meaning and may model a 3D image.

The "object to which the liquid can be adhered" means an object to which the liquid can be temporarily adhered, can be adhered to be fixed, and can be adhered and seep. The "object to which the liquid can be adhered" is, for example, a recording medium such as paper, recording paper, record paper, film, and cloth, an electronic part such as an electronic board and a piezoelectric element, a medium such as a powder layer, an organ model, and an inspection cell. The "object to which the liquid can be adhered" includes everything to which the liquid adheres unless specifically limited.

The material of the "object to which the liquid can be adhered" is sufficient if the liquid can temporarily be adhered. The material is paper, thread, fiber, cloth, leather, metal, plastic, glass, ceramics, or the like.

Although the "device of discharging liquid" includes a device in which the liquid discharge head and the object to which the liquid can be adhered relatively move, the "device of discharging liquid" is not limited thereto. As a specific example, a serial type apparatus causing the liquid discharge head to move, a line type apparatus causing the liquid discharge head not to move, and so on are mentioned.

The "device of discharging liquid" is also a treatment liquid coating apparatus, in which treatment liquid is discharged onto the surface of paper in order to reform the surface of the paper, an injection granulation apparatus, in which constituent humor obtained by dispersing raw material into the solution is injected through a nozzle to conduct a granulation of raw material, or the like.

The terminologies in the present application such as image formation, recording, typing, copying, printing, modeling, or the like may be synonymous words.

According to the embodiment of the present invention, it is possible to improve the adhesive strength.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the liquid discharge head has been described in detail, it should be understood that various changes, substitutions, and alterations could be made thereto without departing from the spirit and scope of the invention.

What is claimed is:

1. A liquid discharge head comprising a flow path substrate including an individual liquid chamber communicating with a nozzle of discharging liquid; and a holding substrate joined to the flow path substrate by an adhesive bond and having an opening communicating with the individual liquid chamber, wherein the opening of the holding substrate has a wall surface crossing relative to a joining surface between the flow path substrate and the holding substrate, an uneven portion is provided on the wall surface of the opening of the holding substrate, the uneven portion extending along a first direction that is parallel with the joining surface of the holding substrate and being arranged in a second direction orthogonal to the first direction, and a part of the adhesive bond adheres to the uneven portion on the wall surface.

2. The liquid discharge head according to claim 1, wherein a size of the uneven portion formed on the wall surface of the holding substrate in a depth direction is equal to or smaller than a thickness of the adhesive bond between joining surfaces between the flow path substrate and the holding substrate.

3. The liquid discharge head according to claim 1, wherein the holding substrate includes multiple wall surfaces, and the uneven portion having a constant shape is provided on each of the multiple wall surfaces.

4. A liquid discharge unit comprising:

a liquid discharge head including a flow path substrate including an individual liquid chamber communicating with a nozzle of discharging liquid; and a holding substrate joined to the flow path substrate by an adhesive bond and has an opening communicating with the individual liquid chamber, wherein the opening of the holding substrate has a wall surface crossing relative to a joining surface between the flow path substrate and the holding substrate, an uneven portion is provided on the wall surface of the opening of the holding substrate, the uneven portion extending along a first direction that is parallel with the joining surface of the holding substrate and being arranged in a second direction orthogonal to the first direction, and a part of the adhesive bond adheres to the uneven portion on the wall surface.

5. The liquid discharge unit according to claim 4, wherein the liquid discharge head is unified with at least one of:

a head tank storing the liquid to be supplied to the liquid discharge head;

a carriage in which the liquid discharge head is installed;

a supplying mechanism configure to supply the liquid to the liquid discharge head;

a maintenance and restoration mechanism configured to perform maintenance and restoration; and a main scanning movement mechanism configured to cause the liquid discharge head to move in a main scanning direction.

6. The liquid discharge unit according to claim 4, wherein the wall surface and the joining surface of the opening of the holding substrate is covered by a surface treatment film having a liquid resistance, and the surface of the adhesive bond that is exposed within the opening and adhered to the uneven portion is covered by the surface treatment film having a liquid resistance.

7. The liquid discharge unit according to claim 4, wherein the uneven portion has a width in a range of 0.1 to 1 μm and a depth in a range of 0.1 to 1 μm.

8. A liquid discharging device comprising:

a liquid discharge head including a flow path substrate including an individual liquid chamber communicating with a nozzle of discharging liquid; and a holding substrate joined to the flow path substrate by an adhesive bond and has an opening communicating with the individual liquid chamber, wherein the opening of the holding substrate has a wall surface crossing relative to a joining surface between the flow path substrate and the holding substrate, an uneven portion is provided on the wall surface of the opening of the holding substrate, the uneven portion extending along a first direction that is parallel with the joining surface of the holding substrate and being arranged in a second direction orthogonal to the first direction, and a part of the adhesive bond adheres to the uneven portion on the wall surface.

9. The liquid discharge head according to claim 1, wherein the wall surface and the joining surface of the opening of the holding substrate is covered by a surface treatment film having a liquid resistance, and the surface of the adhesive bond that is exposed within the opening and adhered to the uneven portion is covered by the surface treatment film having a liquid resistance.

10. The liquid discharge head according to claim 1, wherein the uneven portion has a width in a range of 0.1 to 1 μm and a depth in a range of 0.1 to 1 μm.

11. The liquid discharging device according to claim 8, wherein, in the liquid discharge head, the wall surface and the joining surface of the opening of the holding substrate is covered by a surface treatment film having a liquid resistance, and the surface of the adhesive bond that is exposed within the opening and adhered to the uneven portion is covered by the surface treatment film having a liquid resistance.

12. The liquid discharging device according to claim 8, wherein the uneven portion has a width in a range of 0.1 to 1 μm and a depth in a range of 0.1 to 1 μm.

* * * * *